US005961360A

United States Patent [19]

Nishimura et al.

[11] Patent Number: 5,961,360

[45] Date of Patent: Oct. 5, 1999

[54] CATHODE RAY TUBE AND MANUFACTURING METHOD THEREFOR

[75] Inventors: Takashi Nishimura; Toru Takahashi, both of Fukaya, Japan

[73] Assignee: Kabushiki Kaisha Toshiba, Kawasaki, Japan

[21] Appl. No.: 09/002,886

[22] Filed: Jan. 5, 1998

Related U.S. Application Data

[62] Division of application No. 08/686,681, Jul. 26, 1996, Pat. No. 5,751,094.

[30] Foreign Application Priority Data

Jul. 27, 1995 [JP] Japan ..... 7-191963

[51] Int. Cl.[6] ..... H01J 9/18

[52] U.S. Cl. ..... 445/24

[58] Field of Search ..... 445/24, 25

[56] References Cited

U.S. PATENT DOCUMENTS

| | | | |
|---|---|---|---|
| 4,900,981 | 2/1990 | Yamazaki et al. . | |
| 5,287,034 | 2/1994 | Kamohara et al. . | |
| 5,365,142 | 11/1994 | Nishimura et al. . | |
| 5,413,513 | 5/1995 | Horne et al. | 445/24 |
| 5,506,467 | 4/1996 | Nishimura et al. . | |
| 5,803,781 | 9/1998 | Nishimura et al. | 445/24 |

FOREIGN PATENT DOCUMENTS

| | | |
|---|---|---|
| 0634775 A1 | 1/1995 | European Pat. Off. . |
| 1-124936 | 5/1989 | Japan . |
| 1-130451 | 5/1989 | Japan . |
| 1-130452 | 5/1989 | Japan . |
| 5-036363 | 2/1993 | Japan . |
| 7-078570 | 3/1995 | Japan . |

OTHER PUBLICATIONS

Patent Abstracts of Japan vol. 013, No. 381 (E–810), Aug. 23, 1989 & JP 01 130452 A (Matsushita Electric Ind Co Ltd). May 23, 1989.

*Primary Examiner*—Kenneth J. Ramsey
*Attorney, Agent, or Firm*—Pillsbury Madison & Sutro LLP

[57] ABSTRACT

A phosphor screen is formed on an inner surface of a faceplate and has a plurality of regions which are dividedly scanned by electron beams emitted from a plurality of electron guns. Support units are arranged between the faceplate and a rear plate of an envelope so as to support the faceplate and rear plate under atmospheric pressure. Each of the support units includes a plurality of support members, each having one end abutting against the faceplate and the other end abutting against the rear plate, and a plurality of connecting members each connecting a predetermined number of support members and fixed to the faceplate.

3 Claims, 6 Drawing Sheets

CATHODE RAY TUBE AND MANUFACTURING METHOD THEREFOR

This is a division of application Ser. No. 08/686,681, filed Jul. 26, 1996, now U.S. Pat. No. 5,751,094.

BACKGROUND OF THE INVENTION

1. Field of the Invention

The present invention relates to a cathode ray tube, and more particularly, to a cathode ray tube capable of big-screen display, in which a plurality of divided regions of a phosphor screen are scanned separately, and images obtained in the individual regions are joined together to form a composite image, and a manufacturing method therefor.

2. Description of the Related Art

Recently, high-quality broadcasting and big-screen high-resolution cathode ray tubes therefor have been examined in various ways. Described in U.S. Pat. Nos. 5,365,142 and 5,287,034, Jpn. Pat. Appln. KOKAI Publication No. 5-36363, etc. are cathode ray tubes in which a plurality of divided regions of a phosphor screen with an integral structure are separately scanned with electron beams that are emitted from a plurality of electron guns.

The cathode ray tubes of this type are provided with an envelope including a faceplate and a rear plate, which are substantially flat in shape and are opposed to each other. A phosphor screen is formed on the inner surface of the faceplate. A plurality of funnels are fixed to the rear plate, and an electron gun is disposed in the neck of each funnel.

In these cathode ray tubes, a plurality of supports are arranged inside the envelope, in order to bear an atmospheric load that acts on the flat faceplate and rear plate. It is advisable to locate the supports so that they are in contact with a nonluminous section of the phosphor screen. According to the cathode ray tube described in U.S. Pat. No. 5,365,142, the phosphor screen is of a black-stripe type having stripe-shaped light absorbing layers (black stripe layers), and the supports are arranged so that their respective wedge-shaped distal end portions abut against the light absorbing layers.

In the case where the distal ends of the supports are thus arranged on the stripe-shaped light absorbing layers, they must be aligned accurately with the light absorbing layers. According to a positioning method described in Jpn. Pat. Appln. KOKAI Publication No. 7-78570, the supports are fixed to the rear plate in advance, and the rear plate, having the supports thereon, and the faceplate are provided with positioning means, individually. The respective distal end portions of the supports are aligned with the light absorbing layers of the phosphor screen by assembling the rear plate and the faceplate in predetermined relative positions, with the positioning means used as references.

In this assembly method, however, the respective positions of the supports relative to the phosphor screen are set indirectly by means of the positioning means that are attached individually to the rear plate and the faceplate. Accordingly, positioning the supports with respect to the phosphor screen with use of the positioning means involves the following problems.

(a) The supports are fixed with low accuracy. Since each support has its proximal end portion fixed to the rear plate, the positional accuracy of its distal end portion, which is in contact with the phosphor screen, is liable to be lowered due to fall or the like of the support.

(b) The accuracy of positioning by the positioning means is low. In general, the positioning means attached to the faceplate and the rear plate have a slidable fitting structure, and require a smooth sliding motion when they are positioned.

Further, the positioning means must be constructed so that they can undergo a smooth displacement attributable to thermal expansion without seizing, during a heat treatment for the formation of the envelope, which involves sintering of frit glass. Thus, a relatively wide clearance is required between the two positioning means. In this case, the feasible positioning accuracy is 0.1 mm or thereabout, which is inadequate for high-accuracy positioning. In consequence, a satisfactory accuracy cannot be enjoyed if this positioning structure is applied to a high-precision color cathode ray tube that has a phosphor screen whose phosphor layers and light absorbing layers are arranged at fine pitches.

(c) The positioning means cannot be easily applied to large-sized cathode ray tubes. With the increase of the screen size, the positioning means for keeping the faceplate and the rear plate in the predetermined relative positions are expected be tougher, so that their weight increases. In the case of a big screen, it is difficult, in view of both strength and accuracy, to position the two plates by using the positioning means that are only two or thereabout in number. It is necessary, therefore, to increase the number of the positioning means used for this purpose. Thus, the positioning means for maintaining the predetermined relative positions of the faceplate and the rear plate are not effective means to cope with the increase in size of the cathode ray tubes, entailing complicated construction, increased weight, and higher costs.

SUMMARY OF THE INVENTION

The present invention has been contrived in consideration of these circumstances, and its object is to provide a cathode ray tube, in which support means for supporting a faceplate and a rear plate can be positioned highly accurately with respect to a phosphor screen on the inner surface of the faceplate, thus ensuring large-sized, high-precision screen display, and a manufacturing method therefor.

In order to achieve the above object, a cathode ray tube according to the present invention comprises a vacuum envelope including a substantially rectangular flat faceplate and a substantially rectangular flat rear plate opposed to the faceplate, a phosphor screen formed on the inner surface of the faceplate, support means located between the faceplate and the rear plate and supporting the faceplate and the rear plate under atmospheric pressure, and a plurality of electron guns for emitting electron beams to the phosphor screen so that a plurality of regions of the phosphor screen are dividedly scanned with the electron beams. The support means includes a plurality of support members, each having opposite ends abutting individually against the faceplate and the rear plate, and a plurality of connecting members each connecting a predetermined number of support members and fixed to the faceplate.

According to the cathode ray tube of the invention, moreover, the faceplate has a vertical axis and a horizontal axis crossing each other at right angles, the support members are arranged in a plurality of columns parallel to the vertical axis, and each of the connecting members connects the support members in each corresponding column parallel to the vertical axis.

The faceplate has reference marks against which the respective one ends of the support members abut directly, whereby the support members are aligned with respect to the phosphor screen.

According to the invention, furthermore, the reference marks are formed on an inner surface of the faceplate outside the phosphor screen.

The reference marks are formed in a manner such that the respective one ends of the support members aligned therewith are seeable through the faceplate from the outside.

A method for manufacturing a cathode ray tube according to the present invention, which comprises a vacuum envelope including a substantially rectangular flat faceplate and a substantially rectangular flat rear plate opposed to the faceplate, a phosphor screen formed on the inner surface of the faceplate, support means located between the faceplate and the rear plate and supporting the faceplate and the rear plate under atmospheric pressure, and a plurality of electron guns for emitting electron beams to the phosphor screen so that a plurality of regions of the phosphor screen are dividedly scanned with the electron beams, comprises the steps of: preparing a plurality of support units each including a plurality of support members, each having one end abutting against the faceplate and the other end abutting against the rear plate, and a connecting member connecting the support members; positioning the support members of each support unit in predetermined positions with respect to the phosphor screen; fixing the connecting member of each positioned support unit to the faceplate so that the respective one ends of the support members abut against the inner surface of the faceplate; and joining the rear plate to the faceplate so that the respective other ends of the support members abut against the rear plate.

According to the cathode ray tube and the manufacturing method arranged in this manner, a plurality of support members are connected integrally by means of each connecting member, and the respective screen-side end portions of the integrally connected support members are positioned with respect to the phosphor screen. Thus, the accuracy of positioning of the support members with respect to the phosphor screen is improved. Further, the construction and manufacture of this cathode ray tube can be simplified, since the support members, which require very high arrangement accuracy, are mounted directly on the faceplate on which the phosphor screen is formed. In consequence, the invention can be also applied satisfactorily to high-precision color cathode ray tubes in which phosphor layers are arranged at fine pitches.

The support members can be positioned directly with respect to the phosphor screen without the aid of any other member. Thus, cumulative errors, which are caused when the support members are positioned indirectly with respect to the phosphor screen by using some other member, are reduced. Moreover, the support members are positioned at normal temperature, and can be located accurately in the predetermined positions, so that they cannot be easily influenced by a heat treatment process. As compared with the conventional case in which heavyweight positioning means is used, therefore, the cathode ray tube need not be complicated in construction or stiffened, so that the manufacturing costs can be lowered.

In the case where a plurality of support members arranged in the direction of the vertical axis are connected integrally by means of one connecting member, in particular, the connecting member can be fixed to the faceplate, so that the construction of the cathode ray tube can be simplified.

With use of the reference marks formed on the phosphor screen, moreover, the support members can be easily positioned with respect to the phosphor screen. The accuracy of positioning of the support members connected by means of one connecting member can be greatly improved by aligning some of the support members connected by means of the connecting member with the reference marks.

The reference marks for positioning the support members can be located accurately in the predetermined positions with respect to the phosphor screen by being formed in the same forming process for the phosphor screen during the manufacture of the cathode ray tube. Based on these reference marks, the support members can be arranged highly accurately with respect to the phosphor screen. Thus, practical cathode ray tubes with high mass-producibility can be manufactured with ease.

Further, the support members serve as members for supporting atmospheric pressure, and are applied with pressure in a direction perpendicular to the faceplate and rear plate and in an axial direction of each support member. On the other hand, each of the connecting members serves as a member for connecting a plurality of the support members and is applied with no atmospheric pressure.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 1 to 11 show a color cathode ray tube according to an embodiment of the present invention, in which:

FIG. 1 is a perspective view of the color cathode ray tube,

FIG. 2 is a sectional view taken along line II—II of FIG. 1,

FIG. 3 is an exploded perspective view of the color cathode ray tube,

FIG. 5 is a perspective view showing one mask piece and a mask frame of the color cathode ray tube, FIG. 6 is a perspective view showing part of a support unit of the color cathode ray tube, FIG. 7 is a sectional view of the support unit, FIG. 8 is a sectional view for illustrating a layout of the support unit, mask pieces, and a vacuum envelope, FIG. 9 is a sectional view showing the support unit and an assembly jig used in assembling the support unit, FIG. 11 is a sectional view showing a layout of the support unit, a mask piece, and the vacuum envelope.

DETAILED DESCRIPTION OF THE PREFERRED EMBODIMENTS

A color cathode ray tube according to an embodiment of the present invention will now be described in detail with reference to the accompanying drawings.

Figure 1:
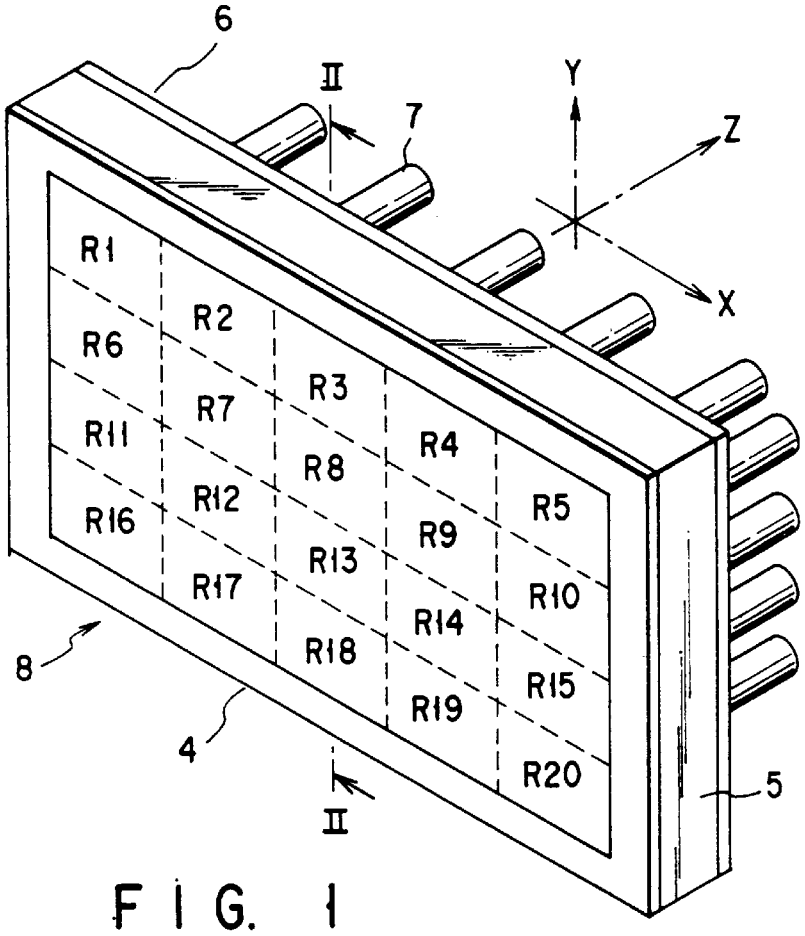
Figure 2:
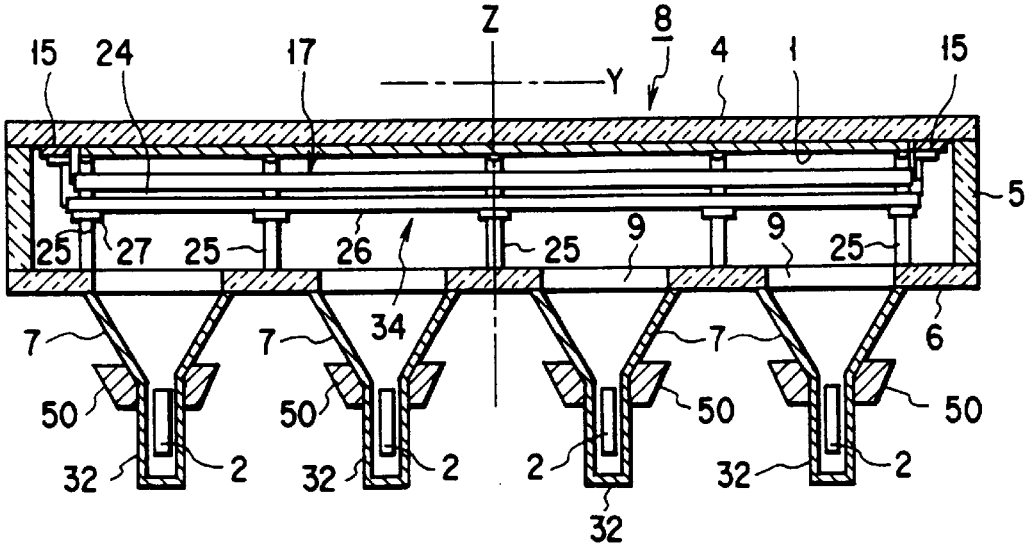
Figure 3:
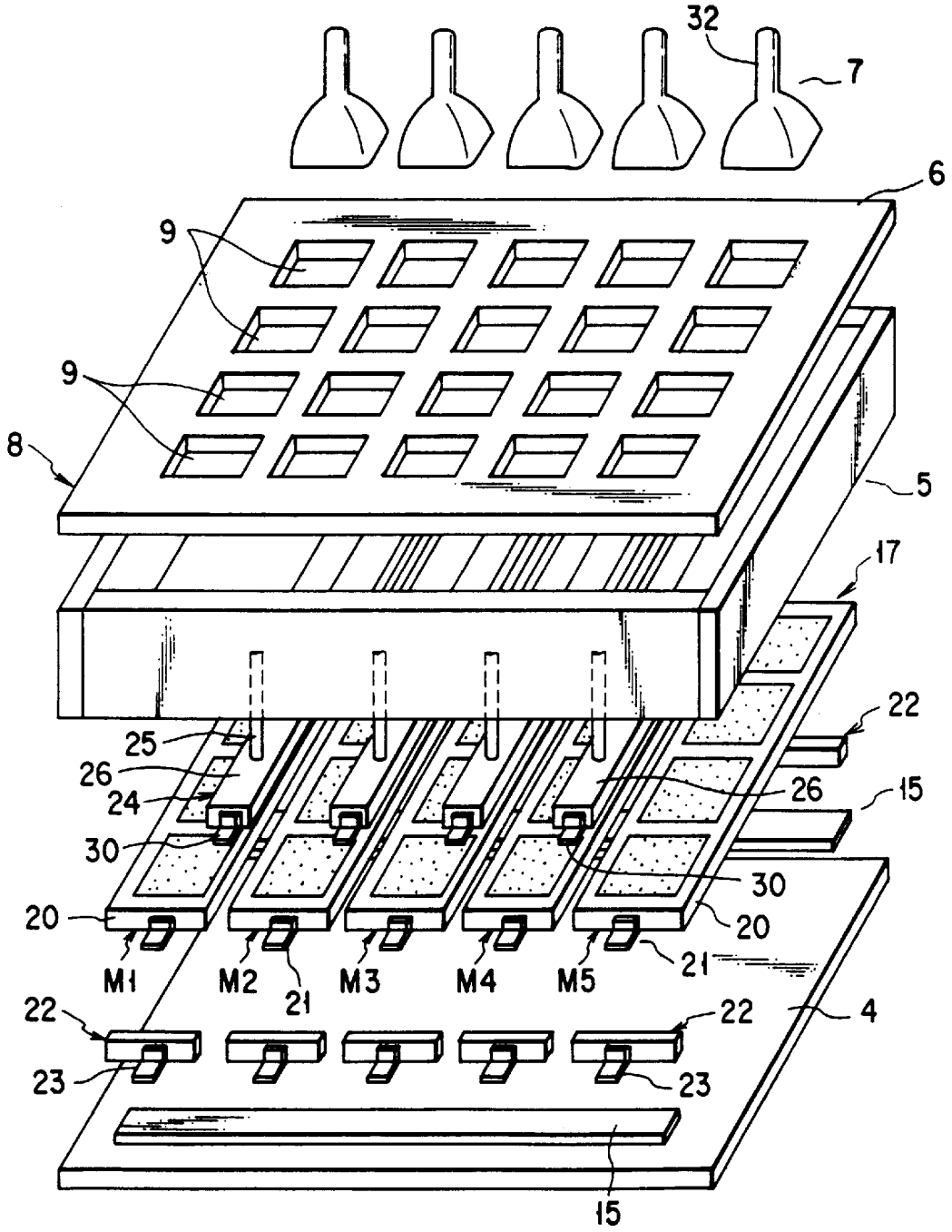

In the color cathode ray tube, as shown in FIGS. 1 to 3, a single phosphor screen 1, which is formed on the inner surface of a faceplate 4, has a plurality of regions R1 to R20, twenty in total number in the example illustrated, constituting a four-row, five-column matrix. These regions R1 to R20 are dividedly scanned with electron beams emitted from a plurality of electron guns 2, and divisional images obtained in the individual regions are joined together so that a composite color image is displayed on the phosphor screen 1.

The color cathode ray tube is provided with a vacuum envelope B, which includes the faceplate 4, a side wall 5, a rear plate 6, and twenty glass funnels 7. The faceplate 4 is a substantially rectangular flat glass structure having a horizontal axis (major axis or X-axis) and a vertical axis (minor axis or Y-axis) that cross each other at right angles. The side wall 5 is a glass frame that is joined substantially perpendicularly to the peripheral edge portion of the faceplate 4. The rear plate 6 is a substantially rectangular flat glass structure that is joined to the side wall 5 and opposed parallel to the faceplate 4. The funnels 7 are joined to the rear plate 6. The rear plate 6 has twenty rectangular apertures 9 arranged in the form of a four-row, five-column matrix, which corresponds to the matrix of the regions R1 to R20 of the phosphor screen 1. The funnels 7 are connected to the outer surface of the rear plate 6 so as to surround their corresponding apertures 9.

Figure 4A:
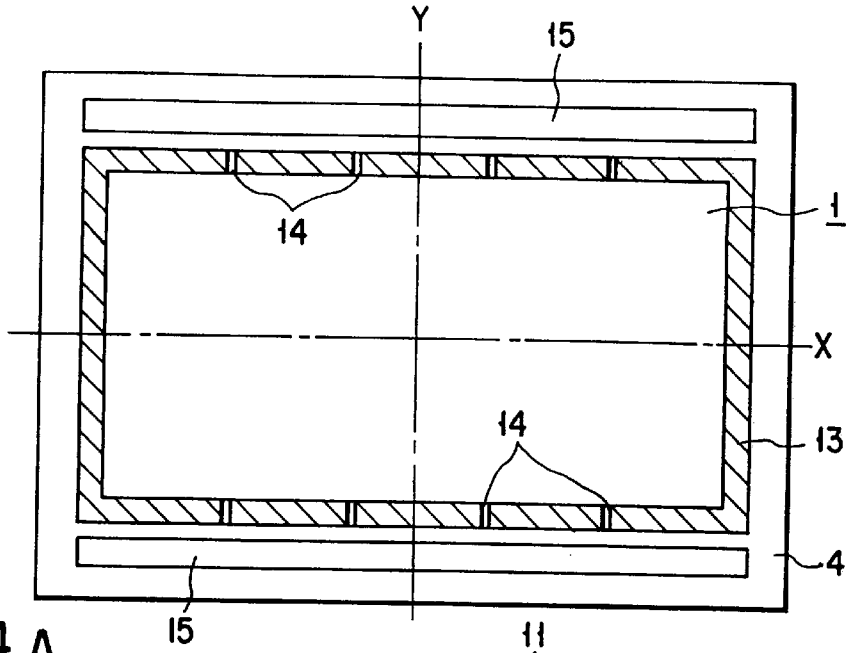
FIG. 4A is a plan view showing a phosphor screen of the color cathode ray tube.
Figure 4B:
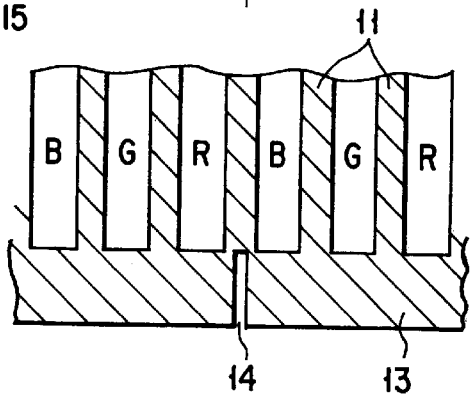
FIG. 4B is an enlarged plan view showing part of the phosphor screen.

As shown in FIGS. 4A and 4B, the phosphor screen 1 of an integral structure is formed on the inner surface of the faceplate 4. In this screen 1, light absorbing layers (black stripe layers) 11 in the form of vertically elongated stripes are arranged at predetermined intervals in the horizontal direction. Also, three-color phosphor layers B, G and R in the form of vertically elongated stripes, capable of emitting blue, green, and red lights, respectively, are formed so as to fill up the intervals or gaps between the light absorbing layers 11. The phosphor screen 1 is rectangular as a whole. On the inner surface of the faceplate 4, a frame-shaped nonluminous section 13, formed of the same material as the light absorbing layers 11 and having a fixed width, is provided on the outer periphery of the phosphor screen 1.

According to the present embodiment, moreover, four reference marks 14 for positioning support members (mentioned later) are formed on each of a pair of horizontal sides of the nonluminous section 13. Each reference mark 14, which is situated on the extension of its corresponding stripe-shaped light absorbing layer 11, is formed by partially removing the nonluminous section 13 to expose the faceplate surface. More specifically, each mark 14 is in the form of a slit extending in the vertical direction so that the screen-side end portion of its corresponding support member can be seen through the faceplate 4 and the mark 14 from the outer surface side of the faceplate.

Also, a pair of fixing members 15, each in the form of a horizontally elongated strip, are fixed to the inner surface of the faceplate 4, outside the nonluminous section 13 on either side in the vertical direction, by means of frit glass. Each of the fixing member 15 is formed of nickel alloy which has a thermal expansion coefficient similar to that of the glass faceplate 1.

A shadow mask 17 faces the phosphor screen 1 inside the faceplate 4. The mask 17 is divided into five rectangular flat mask pieces M1 to M5, which are elongated in the vertical direction and arranged corresponding individually to the five columns of regions of the phosphor screen 1.

Figure 5:
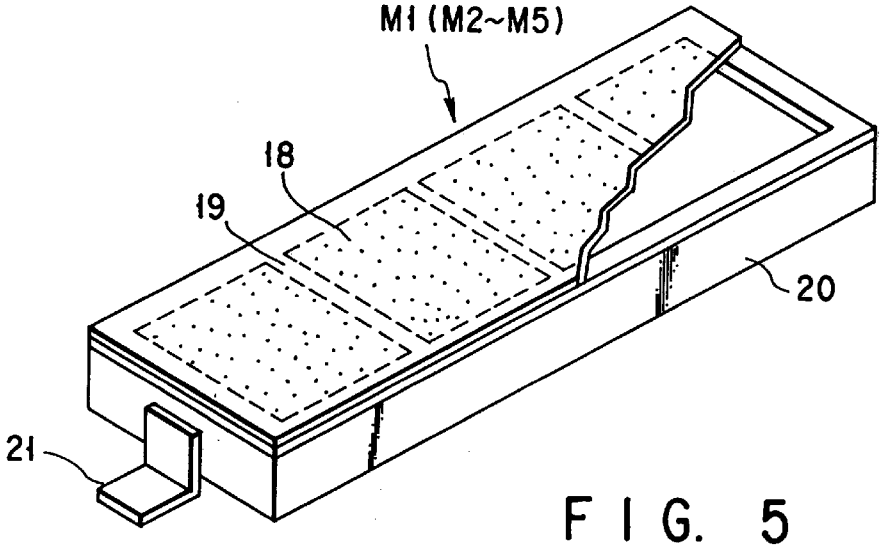

As shown in FIG. 5, each of the mask pieces M1 to M5 includes four rectangular effective portions 18 arranged in the longitudinal direction, corresponding individually to the four rows of regions of the phosphor screen 1. A large number of electron beam apertures are formed in each effective portion 18. The individual effective portions 18 are coupled together by means of a noneffective portion 19 in which no electron beam apertures are formed.

The mask pieces M1 to M5 are mounted individually on rectangular mask frames 20 that are elongated in the vertical direction, and are arranged at predetermined intervals in the horizontal direction. Each mask frame 20 is held on the faceplate 4 by fastening fixing pieces 21 on the longitudinally opposite side portions of the frame to the fixing members 15 on the inner surface of the faceplate 4. Thus, the respective effective portions 18 of the mask pieces face their corresponding regions of the phosphor screen 1.

Pairs of stages 22 are arranged between the inner surface of the faceplate 4 and the mask pieces M1 to M5 that are fixed to the fixing members 15 by means of the mask frames 20. The stages 22 serve to set a predetermined space (value q) between the inner surface of the faceplate 4 and the mask pieces. One end portion of each stage 22 is fixed to its corresponding fixing member 15 by means of a fixing piece 23, while the other end portion is pressed against its corresponding mask piece, passing inside each corresponding vertical end portion of its corresponding mask frame 20, thereby applying a tension to the mask piece.

A support mechanism 24 for supporting an atmospheric load acting on the faceplate 4 and the rear plate 6 is interposed between these plates 4 and 6. The support mechanism 24 includes, for example, twenty cylindrical support members 25 and connecting members 26 integrally connecting the support members. Each support member 25 extends substantially perpendicular to the faceplate 4 and the rear plate 6, and has its distal and proximal ends abutting against the plates 4 and 6, respectively.

The support members 25 are arranged so that each of their respective distal ends abuts against the point of intersection of the boundaries between each corresponding four adjacent ones of the regions R1 to R20 of the phosphor screen 1 or that portion of each horizontal side of the nonluminous section 13 which is situated near the boundary between each corresponding two horizontally adjacent regions. Thus, the support members 25 are twenty in total number, and constitute a five-row, four-column matrix. The five support members 25 in each column are connected one another by means of each corresponding connecting member 26, and constitute a support unit 34.

Figure 6:
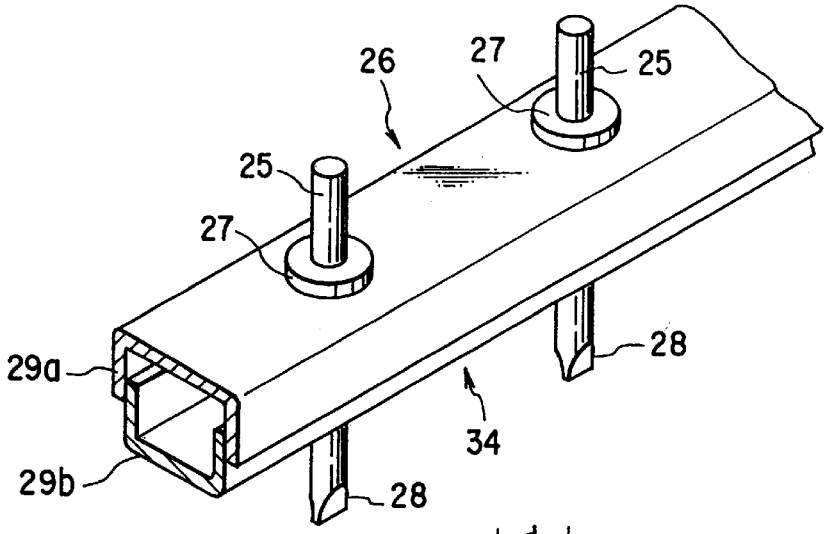
Figure 7:
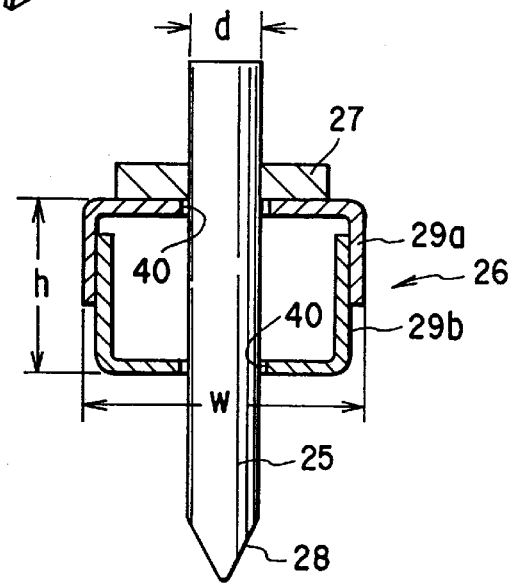

Each support member 25, which is shown in detail in FIGS. 6 and 7, is formed of a material, such as a nickel alloy, whose coefficient of thermal expansion is approximate to that of glass, i.e., the material of the faceplate 4 and the rear plate 6, and has a uniform potential throughout its length from the distal end to the proximal end. The distal end 28 of each support member 25 on the faceplate side is wedge-shaped.

Each connecting member 26 includes a pair of elongated fitting members 29*a* and 29*b*, which have a U-shaped cross section each, and is in the form of a square tube constructed by joining the respective opening sides of the fitting members. The fitting members 29*a* and 29*b* are formed of a material, such as a nickel alloy, whose coefficient of thermal expansion is approximate to that of glass, the material of the faceplate 4 and the rear plate 6, and at least its surface has electrical conductivity. Each of the fitting members 29*a* and 29*b* is formed having five through holes 40 through which the support members 25 are passed individually, the corresponding holes 40 of the fitting members 29*a* and 29*b* coaxially facing each other. A fixing piece 30 is attached to each of the longitudinally opposite end portions of each connecting member 26. The connecting member 26 is fixed to the fixing members 15 on the faceplate 4 through the fixing pieces 30.

A ring-shaped collar 27 is fixed in a predetermined axial position on each support member 25, such that the support member 25 is attached accurately and firmly to the connecting member 26. Each support member 25 is passed through each facing pair of through holes 40 in the connecting member 26, and is fixed to the connecting member 26 by welding the collar 27 to the fitting member 29*a*. Thus, the five support members 25 in each support unit 34 extend parallel to one another, and are connected to one another by means of the connecting member 26 that extends perpendicular to the support members 25. Also, the five support members 25 are connected in a manner such that their respective distal ends 28 are aligned in the longitudinal direction of the connecting member 26.

More specifically, each support member 25 is in a columnar shape having a diameter d of 8 mm, and its wedge-shaped distal end 28 has a width of 0.05 mm and a length of 8 mm, which is equal to the diameter d of the support member 25. The connecting member 26 has a width w of 12 mm, height h of 10 mm, and length of 350 mm. The collar 27 is formed of a stainless-steel ring with a diameter of 10 mm and thickness of 5 mm.

Figure 8:
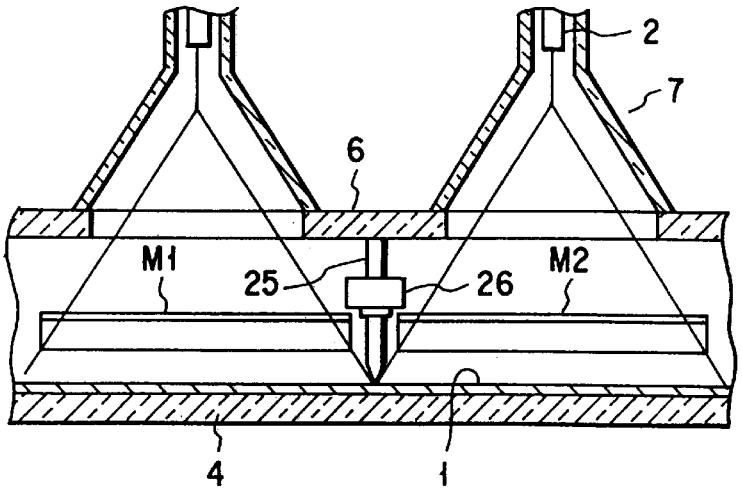

As shown in FIGS. 2 and 8, each support unit 34 is mounted on the faceplate 4 in a manner such that the fixing pieces 30 attached to the opposite ends of its corresponding connecting member 26 are fixed individually to the fixing members 15 on the vertically opposite sides of the inner surface of the faceplate 4. In this case, the four support units 34 are arranged so that the longitudinal direction of each connecting member 26 is in line with the vertical direction of the faceplate 4, and that each of them is situated between its corresponding two horizontally adjacent mask pieces (M1 and M2 in FIG. 8). Moreover, each support unit 34 is located so that the respective distal ends 28 of the two support members 25 at its longitudinally opposite end portions of the connecting member 26 are situated corresponding individually to the reference marks 14 in the nonluminous section 13 of the phosphor screen 1, and the respective distal ends 28 of the three intermediate support members 25 are situated on one of the light absorbing layers 11 at the points of intersection of the boundaries between the adjacent regions of the phosphor screen 1.

On the other hand, an electron gun 2 is provided in a neck 32 of each of the twenty funnels 7, and a deflecting yoke 50 for scanning an electron beam emitted from the electron gun in the horizontal and vertical directions is mounted surrounding the neck 32.

In the color cathode ray tube constructed in this manner, electron beams emitted from the electron guns 5 in the respective necks 32 of the twenty funnels 7 are deflected in the horizontal and vertical directions by magnetic fields that are generated by the deflecting yokes 50. The twenty regions R1 to R20 in the four-row, five-column matrix of the phosphor screen 1 are separately scanned with the deflected electron beams that are passed through the shadow mask 17. Divided images formed on the phosphor screen 1 by the separate scanning are joined together without overlapping or gaps by means of signals applied to the electron guns 2 and the deflecting yokes 50, whereupon a composite color image is displayed on the screen 1.

The color cathode ray tube with the above-described construction are manufactured in the following processes.

Figure 9:
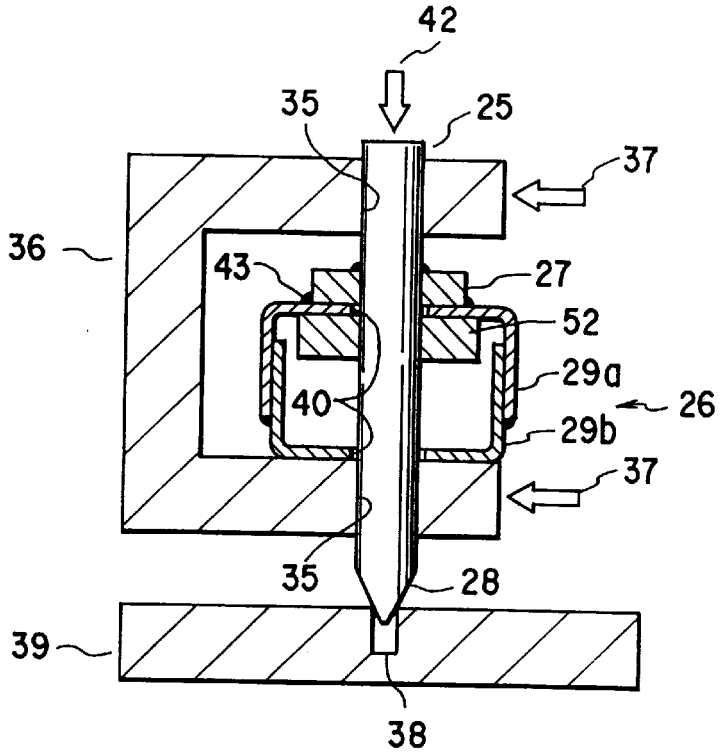

First, the way of assembling each support unit 34 will be described. The support unit 34 is assembled by using an assembly jig, as shown in FIG. 9. The assembly jig includes a bearer 36, having a U-shaped cross section and formed with notches 35 for individually supporting the five vertically arranged support members 25, and a presser (not shown) for pressing the bearer 36 sideways, as indicated by arrows 37, so that the support members 25 supported by the bearer 36 extend vertically. The assembly jig further includes an end regulator 39, which is provided with a groove 38 adapted to engage the respective wedge-shaped distal ends 28 of the support members 25 supported by the bearer 36, thereby regulating the positions of the distal ends 28, and a connecting member regulator 52 for regulating the position of the connecting member 26 with respect to the support members 25 supported by the bearer 36.

The groove 38 of the end regulator 39, compared with each support member 25 having the diameter of 8 mm and the distal end width of 0.05 mm, is in the form of a rectangular groove 1 mm wide and 3 mm deep.

After the pair of fitting members 29*a* and 29*b* are joined together, in assembling the support unit 34, the connecting member regulator 52 is located so as to be in contact with the inner surface of the fitting member 29*a*, and the fitting members 29*a* and 29*b* are welded together by, for example, laser welding to form the connecting member 26. The resulting connecting member 26 is located inside the bearer 36 with the U-shaped cross section.

Then, the five support members 25, fitted with the collar 27 each, are caused to engage their corresponding notches 35 of the bearer 36, and are passed individually through the through holes 40 in the fitting members 29*a* and 29*b*. At the same time, the respective wedge-shaped distal ends 28 of the support members 25 are fitted into the groove 38 of the end regulator 39.

Subsequently, the respective proximal end portions of the support members 25 are pressurized in the direction indicated by an arrow 42, and the support members 25 are pressurized sideways to be vertically by the presser. In this state, the support members 25, collars 27, and connecting member 26 are welded together by, for example, laser welding. Thereafter, the support unit 34, thus assembled integrally by welding, is drawn out in the direction perpendicular to the drawing plane, to be taken out of the assembly jig. In FIG. 9, black spots represent welded joints of the individual members.

In manufacturing the envelope 8 of the color cathode ray tube, on the other hand, the pair of fixing members 15 are fixed individually on the vertically opposite side portions of the inner surface of the faceplate 4 by means of frit glass (see FIG. 3). Then, the phosphor screen 1 is formed on the inner surface of the faceplate 4, which is fitted with the fixing members 15, by photographic printing using a master mask. In forming the phosphor screen 1, just as in forming a phosphor screen of a conventional color cathode ray tube of the black-stripe type, the stripe-shaped light absorbing layers 11 are first formed by using a sensitizer, black paint, etc. At the same time, the nonluminous section 13 is formed on the outer periphery of the phosphor screen 1, and the reference marks 14 on the nonluminous section 13. The nonluminous section 13 and the reference marks 14 can be obtained simultaneously with the light absorbing layers 11 by previously forming patterns corresponding to the section 13 and the marks 14 on the master mask that is used in forming the layers 11.

Subsequently, a photosensitive phosphor slurry is applied to the inner surface of the faceplate 4, and the stripe-shaped three-color phosphor layers B, G and R are formed in the gaps between the light absorbing layers 11 by using a master mask. Thereafter, an aluminum film is deposited on the back of the phosphor layers B, G and R by sputtering. In doing this, the reference marks 14 and the peripheral portion of the faceplate 4 are covered lest aluminum be deposited thereon.

Besides the phosphor screen 1, the mask pieces M1 to M5 are formed by photoetching, as in the case of shadow mask of the conventional color cathode ray tube. The mask pieces M1 to M5 and the mask frames 20 are positioned with respect to one another by using an assembly jig, and the mask pieces are subjected to a tension lower than a tension to be applied finally. In this state, the opposite end portions of each mask piece are welded to mask piece mounting portions at the longitudinally opposite end portions of the corresponding mask frame 20 by, for example, laser welding (see FIG. 5). The electron guns 2 are previously sealed in the respective necks 32 of the twenty funnels 7.

Thereafter, the stages 22 are positioned and mounted in predetermined positions on the fixing members 15, which are attached to the inner surface of the faceplate 4, by means of an assembly jig (see FIG. 3). Further, each of the mask pieces M1 to M5 is placed on its corresponding pair of stages 22, and the phosphor screen 1 on the inner surface of the faceplate 4 and the mask pieces are positioned in predetermined relative positions. Then, each mask frame 20 is forced into a position such that its fixing pieces 21 are in contact with their corresponding fixing members 15, a tension is applied to each mask piece, and the fixing pieces 21 are welded to the fixing members 15.

Figure 10A:
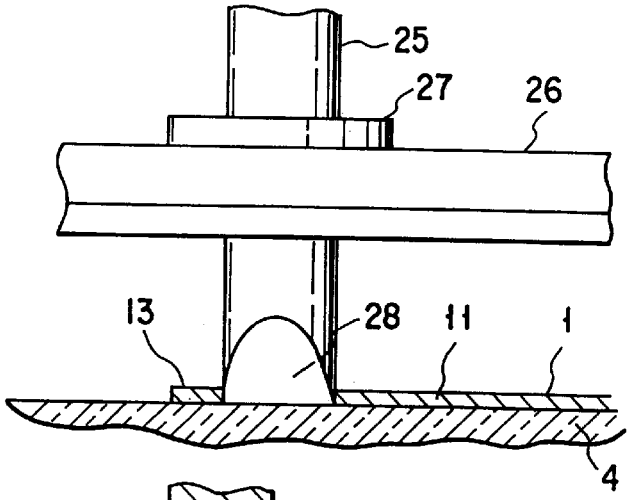
FIG. 10A is a side view showing the relative positions of the distal end of a support member of the support unit and the phosphor screen.
Figure 10B:
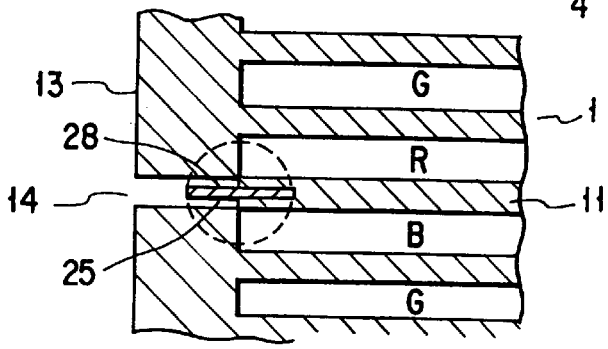
FIG. 10B is a plan view showing the relative positions of the distal end of the support member of the support unit and the phosphor screen.

Then, the four preassembled support units 34 are positioned with respect to the phosphor screen 1 by means of another assembly jig. In doing this, the wedge-shaped distal ends 28 of those support members 25 which are situated on the longitudinally opposite end sides of the connecting members 26 are aligned individually with the reference marks 14 on the nonluminous section 13 around the phosphor screen 1, as shown in FIGS. 10A and 10B. In this process of positioning, moreover, each of the support units 34 is supported such that the respective distal ends 28 of each five support members 25 are held about 0.5 mm above the phosphor screen 1 lest the screen 1 be damaged. In this state, the distal ends 28 of the two support members 25 on the opposite end sides of each connecting member 26 are observed through their corresponding reference marks 14 that are seeable from the outer surface side of the faceplate 4. While doing this, the support units 34 are positioned so that a half of each distal end 28, with respect to its length, is situated on its corresponding reference mark 14 and the remaining half on the corresponding light absorbing layer 11. Subsequently, the positioned support units 34 are forced into and held in positions such that the respective distal ends 28 of the support members 25 are in contact with the phosphor screen 1, and the fixing pieces 30 attached to each connecting member 26 are welded to their corresponding fixing members 15.

Figure 11:
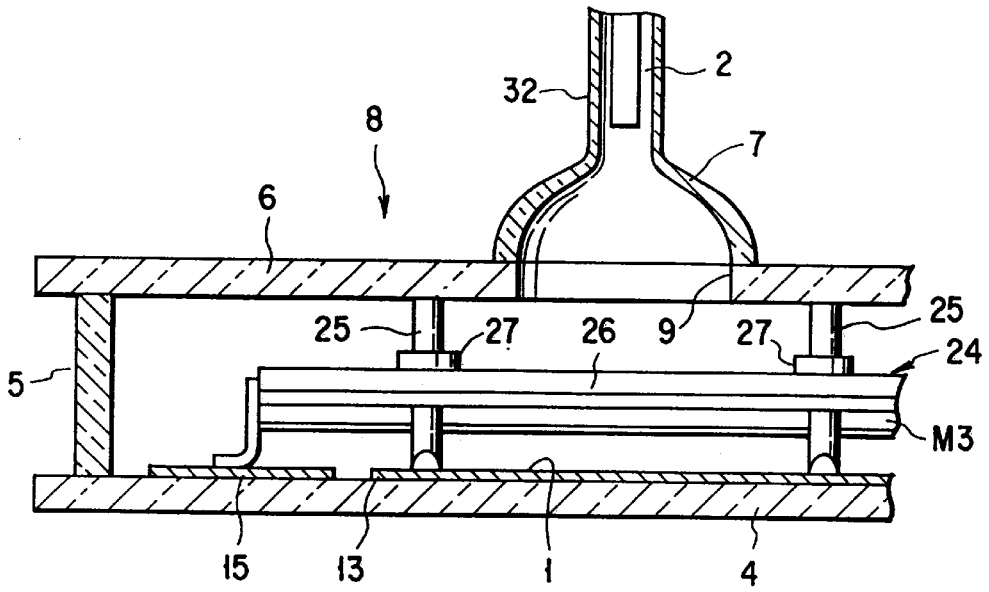

As shown in FIGS. 2 and 11, thereafter, the faceplate 4, which is fitted with the mask pieces M1 to M5 (M3 is shown in these drawings) and the support units 34, the side wall 5, the rear plate 6, and the twenty funnels 7, each having the electron gun 2 therein, are combined in predetermined relative positions by means of still another assembly jig, and joined integrally by means of frit glass. Thereafter, the resulting structure is subjected to exhaust and other processes, as in the manufacture of the conventional color cathode ray tubes, whereupon the color cathode ray tube according to the present embodiment is completed.

According to the color cathode ray tube constructed in this manner, a plurality of support members 25 are integrated by means of each connecting member 26, and the integrated support members 25 and the phosphor screen 1 are positioned directly with respect to one another. Accordingly, cumulative errors in assembly, which may be caused when the support members and the phosphor screen are positioned indirectly, dislocations in a heat treatment process, etc. can be avoided in principle. Thus, all the support members 25 can be arranged highly accurately in the predetermined positions with respect to the phosphor screen 1.

In the case where the phosphor layers B, G and R of the phosphor screen 1 are arranged at fine pitches of 0.5 mm or less, for example, the support members 25 require the arrangement accuracy of 0.05 mm or thereabout. According to the conventional method involving the indirect positioning, however, the positioning means is designed so that its fitting accuracy alone takes a share of 0.05 mm or more, in order to avoid its seizing, and various errors are cumulatively added to this value. Thus, it is hard for the support members 25 to enjoy the arrangement accuracy of the aforesaid level.

In the color cathode ray tube according to the present embodiment, the support members 25 are connected integrally by means of the connecting members 26, and the externally seeable reference marks 14 are formed on the nonluminous section of the phosphor screen 1. With this arrangement, the support members 25 can be arranged highly accurately by being directly positioned with the respective distal ends 28 of the support members 25 observed through the faceplate 4. Thus, the present embodiment can be also applied to high-precision color cathode ray tubes, in which phosphor layers are arranged at fine pitches, and large-sized cathode ray tubes.

Since the shadow mask 17 and the support members 25, which require high arrangement accuracy, are both attached to the faceplate 4 that has the phosphor screen 1 formed thereon, moreover, the construction and manufacture of the color cathode ray tube can be simplified. Further, the support members 25 arranged in each vertical column is connected integrally by means of one and the same connecting member 26, in particular. Accordingly, the support members 25 can be attached to the faceplate 4 by fixing the opposite end portions of the connecting member 26 individually to the fixing members 15 for common use with the shadow mask 17. Thus, the construction and manufacture of the color cathode ray tube can be further simplified.

By aligning some of the support members 25 connected by means of one connecting member 26 to the reference marks 14, the remaining support members 25 connected by the same connecting member can be positioned in their respective predetermined positions. Thus, the accuracy of positioning of the support members 25 with respect to the phosphor screen 1 is improved considerably, and the positioning operation is easy.

The connecting member 26 of each support unit 34 is fixed to the faceplate 4 without any substantial load with respect to the surface direction of the faceplate. Accordingly, there is no possibility of the phosphor screen 1 on the faceplate 4 being damaged by the connecting members 26.

Further, the support members 25 can be positioned with respect to the phosphor screen 1 at normal temperature, there is no need of a complicated structure or strength for the arrangement of conventional heavyweight positioning means, so that the manufacturing costs can be lowered.

Since the reference marks 14 for positioning the support members 25 are formed in the same forming process for the phosphor screen 1, moreover, they can be arranged accurately in the predetermined positions with respect to the screen 1. As a result, the support members 25 can be arranged highly accurately in the predetermined positions with respect to the phosphor screen 1, so that the desired color cathode ray tube can be manufactured with ease.

Since each support member 25 that constitutes the support mechanism 24 is formed of a single columnar member, furthermore, its axial length can be set with high accuracy. Accordingly, the individual support members 25 can be formed having a fixed height without variation, so that the faceplate 4 and the rear plate 6 of the vacuum envelope 8 can be supported steadily by means of the support members.

The connecting member 26 of each support unit 34 is formed of a material whose coefficient of thermal expansion is approximate to that of the material of the faceplate 4 and the rear plate 6. Even when it is heated in heat treatment during the manufacture or by heat generated during operation, therefore, the connecting member 26 expands or contracts substantially at the same rate as the vacuum envelope 8. Thus, the support members 25 that are connected by means of the connecting member 26 can be prevented from being dislocated with respect to the phosphor screen 1.

Since each connecting member 26 is electrically conductive at least on its surface, it cannot be charged electrically with voltage in the vacuum envelope 8 or electron beams. Thus, unexpected deflection of the electron beams or some other trouble attributable to charging of the connecting member 26 can be prevented.

It is to be understood that the present invention is not limited to the embodiment described above, and that various changes and modifications may be effected therein by one skilled in the art without departing from the scope or spirit of the invention.

In the above-described embodiment, for example, each connecting member 26 is formed of the nickel alloy, whose coefficient of thermal expansion is substantially equal to that of the faceplate. However, the connecting member 26 may be formed of any other material whose coefficient of thermal expansion is somewhat different from that of the faceplate, provided that the difference in thermal expansion is small enough not to damage the phosphor screen despite movements, if any, of the support members 25 due to thermal expansion of the connecting member. Also, each support unit 34 may be of any other construction that combines materials with different coefficients of thermal expansion or in which the difference in thermal expansion is lessened by means of an elastic member.

According to the embodiment described above, moreover, the support units are assembled in advance, and all the support members are arranged in the predetermined positions by aligning the specific support members with the reference marks formed on the phosphor screen. However, a color cathode ray tube with the same function can be obtained by a method such that after those support members which can be positioned relatively easily, e.g., those ones which are situated near the center of the phosphor screen, are positioned with use of the reference marks, a plurality of support members are integrated by being fitted with the connecting members.

Figure 12A:
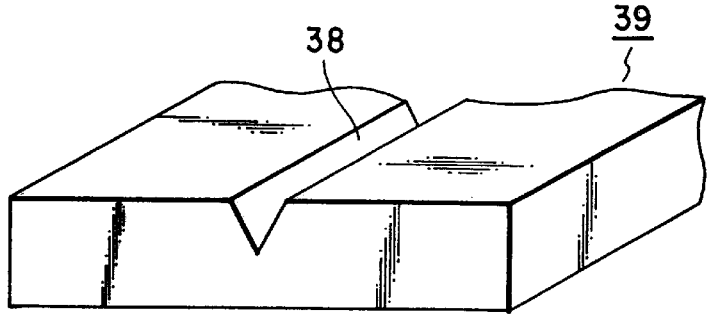
FIGS. 12A and 12B are perspective views individually showing different modifications of the assembly jig.
Figure 12B:
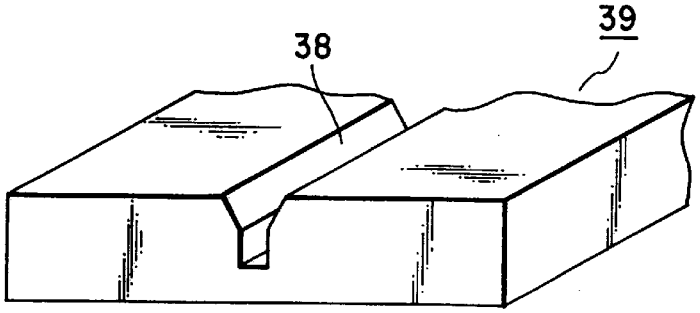

In the foregoing embodiment, furthermore, the groove 38 of the end regulator 39, which regulates the positions of the respective screen-side end portions of the support members, is a rectangular groove. In the case where the screen-side end portions of the support members are wedge-shaped, however, the groove 38 may be in any other suitable shape, e.g., triangular (FIG. 12A) or in a shape combining a triangle and a rectangle (FIG. 12B).

Although the screen-side end portion of each support member is wedge-shaped according to the foregoing embodiment, it may be in any other suitable shape, e.g., needle-shaped or plate-shaped. Alternatively, the screen-side end portion of each support member may be of any other construction, e.g., one having a reference for regulating its position.

In the embodiment described above, moreover, the respective screen-side end portions of those support members which are situated individually at the opposite end portions and positioned with respect to the phosphor screen are wedge-shaped, and their distal ends are aligned with the stripe-shaped light absorbing layers. In the case where these support members are arranged outside the effective region of the phosphor screen, that is, in the nonluminous section, their distal ends need not always be aligned with the light absorbing layers, and may be of any suitable shape for positioning.

In assembling the color cathode ray tube according to the foregoing embodiment, the connecting member of each support unit is fixed to the fixing members on the faceplate. If the envelope is evacuated, however, each support unit is fixed firmly to the envelope under the atmospheric load acting on the faceplate and the rear plate. Accordingly, the support units may be mounted by using a suitable fixing structure that is strong enough not to undergo any displacement attributable to vibration acting thereon during the manufacturing processes.

Further, the present invention is not limited to color cathode ray tubes, such as the one according to the embodiment described herein, and may be also applied to monochromatic cathode ray tubes having no shadow mask, with the same result.

Furthermore, the divided regions of the phosphor screen and the support members of the support mechanism may be changed in number as required. Although each connecting member according to the foregoing embodiment connects the vertically arranged support members in each corresponding column, each support unit may be designed so that a plurality of horizontally arranged support members are connected by means of each connecting member.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method for manufacturing a cathode ray tube, which comprises a vacuum envelope including a substantially rectangular flat faceplate and a substantially rectangular flat rear plate opposed to the faceplate, a phosphor screen formed on the inner surface of the faceplate, support means located between the faceplate and the rear plate and supporting the faceplate and the rear plate under atmospheric pressure, and a plurality of electron guns for emitting electron beams to the phosphor screen so that a plurality of regions of the phosphor screen are dividedly scanned with the electron beams, the method comprising the steps of:

preparing a plurality of support units each including a plurality of support members, each having one end for abutting against the faceplate and the other end for abutting against the rear plate, and a connecting member connecting the support members;

positioning the support members of each support unit in predetermined positions with respect to the phosphor screen;

fixing the connecting member of each positioned support unit to the faceplate so that the respective one ends of the support members abut against the inner surface of the faceplate; and joining the rear plate to the faceplate so that the respective other ends of the support members abut against the rear plate.

2. A cathode ray tube according to claim 1, further comprising the steps of forming a plurality of reference marks on the inner surface of the faceplate, in predetermined positions with respect to the phosphor screen; and wherein each of the support units is positioned by aligning at least one of the support members with the reference mark.

3. A cathode ray tube according to claim 2, wherein said reference marks are formed simultaneously with the formation of the phosphor screen on the inner surface of the faceplate.

* * * * *